US009206731B2

(12) United States Patent
Prevost

(10) Patent No.: US 9,206,731 B2
(45) Date of Patent: Dec. 8, 2015

(54) MANIFOLD FOR USE WITH WATER-COOLED INTERNAL COMBUSTION ENGINES

(76) Inventor: Clemon P. Prevost, Texas City, TX (US)

( * ) Notice: Subject to any disclaimer, the term of this patent is extended or adjusted under 35 U.S.C. 154(b) by 186 days.

(21) Appl. No.: 13/523,389

(22) Filed: Jun. 14, 2012

(65) Prior Publication Data

US 2013/0333645 A1 Dec. 19, 2013

(51) Int. Cl.
*F01P 11/04* (2006.01)

(52) U.S. Cl.
CPC ..... *F01P 11/04* (2013.01); *Y10T 137/85938* (2015.04)

(58) Field of Classification Search
CPC ..... F01P 11/04; F16L 39/00; F16L 41/00; F16L 41/005; F16L 41/02; F16L 41/021; F16L 41/08; F16L 41/086; F16L 41/088; F16L 47/26; Y10T 137/85938
USPC ..... 123/41.28, 41.44; 137/561 A
See application file for complete search history.

(56) References Cited

U.S. PATENT DOCUMENTS 6,379,201 B1 * 4/2002 Biggs et al. ..... 440/88 R
2008/0276998 A1 * 11/2008 Boyher et al. ..... 137/561 A

* cited by examiner

*Primary Examiner* — Lindsay Low
*Assistant Examiner* — Jacob Amick
(74) *Attorney, Agent, or Firm* — Bushman Werner, P.C.

(57) ABSTRACT

A manifold for use in a cooling system in of a water-cooled internal combustion engine. The manifold comprises a body having a first chamber and a second chamber, the first chamber has a first port and first and second opening while the second chamber has a first port and first and second openings. The manifold, in a preferred embodiment, also has a second port into the first chamber and a second port into the second chamber. The manifold is plumbed whereby reverse cooling of an engine can be easily accomplished without removing the manifold from the engine.

9 Claims, 3 Drawing Sheets

M
40
40A
62
62A
60
60A
42
44
46
48
50
52
53
54
55
56
58
64
66
68
70
72
74
80
82
83
84
86
87
88
89
P1
P2
P3
P4
B
5

MANIFOLD FOR USE WITH WATER-COOLED INTERNAL COMBUSTION ENGINES

FIELD OF THE INVENTION

The present invention relates to manifolds for use in a cooling system of a water-cooled, internal combustion engine and, more particularly, to a manifold which can be used with engine conversions in an automobile.

BACKGROUND OF THE INVENTION

So-called "engine swaps" wherein a vehicle's engine is removed and replaced with another, usually are performed because of failure or to install a different engine, usually one that is more powerful or more modern and more maintainable. In one popular type of engine swap, a large engine is installed into a small car in the hopes of achieving a vehicle with a very high power-to-weight ratio. Typically this means creating a vehicle configuration that is not factory original. The most positive aspect of an engine swap of this type is the gain in horse power without a loss of reliability. Fitting an engine into a car that was never designed or intended to accept it can require a great deal of work, e.g., modifying the car to fit the engine, modifying the engine to fit the car, building custom engine mounts and transmission bell housing adapters to interface them along with a custom built drive shaft, etc.

One common problem in a large engine for small engine swap is the necessity to move the water pump to a remote location because of tight engine to body clearances. Most engine water pump adapters are comprised of a two-piece inlet and outlet configuration and "Y" blocks to connect the radiator hoses to the radiator and water pump. There are several disadvantages to this approach. The primary disadvantage is the fact that these excessive hoses can increase the chances of air pockets forming in the cooling system and require the use of expensive NPT fittings to complete the installation. Additionally, such modifications increase clutter in an already confined space in the engine compartment.

Clearly there is a need for some kind of adapter, manifold or the like that is configured to provide better clearance, access and, if desired, ease of reconfiguring reverse cooling of the engine. Such an adapter and manifold must provide access to the space between the engine and the vehicle body. Such a manifold should also enable the engine to be reverse cooled with minimal reconfiguration time. In this regard, many high performance engines are reverse cooled. In this regard, there is a benefit to cooling the combustion heads first, followed by the engine block since it is believed that this reduces combustion detonation, known as knock, spark knock, or pinging. It would further be desirable to have a system without excessive hoses, connections and the like that promote clutter in an already tight area of the vehicle engine compartment.

SUMMARY OF THE INVENTION

In one aspect, the present invention provides a one-piece manifold or adapter for use in the cooling system of an internal combustion engine.

In another aspect, the present invention provides an adapter or manifold which can be used in an engine swap wherein a larger engine replaces a smaller engine.

In yet another aspect, the present invention provides a manifold or water pump adapter which allows for reverse cooling of the engine with a minimal amount of reconfiguration time and without the need for excessive hoses, connections, etc.

These and further features and advantages of the present invention will become apparent from the following detailed description, wherein reference is made to the figures in the accompanying drawings.

DETAILED DESCRIPTION OF PREFERRED EMBODIMENTS

Figure 1:
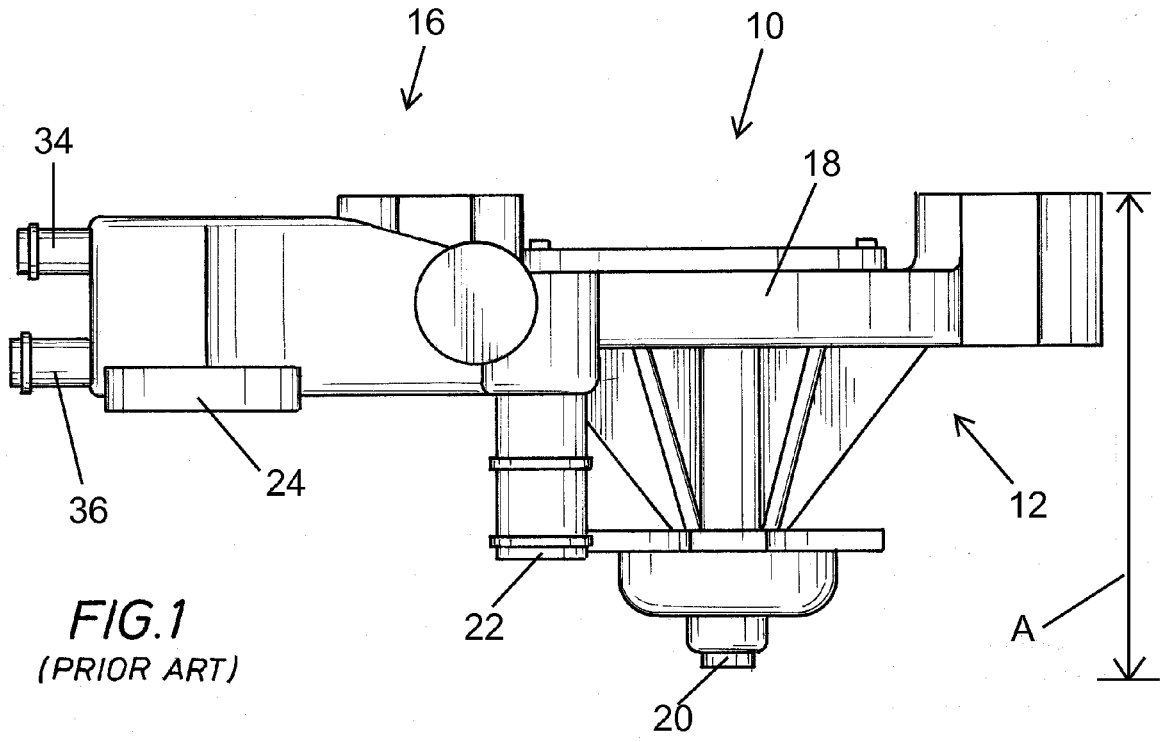
FIG.1 (PRIOR ART)
FIG. 1 is a top view of a typical prior art water pump and water pump adapter used in the cooling system of a typical internal combustion engine.
Figure 2:
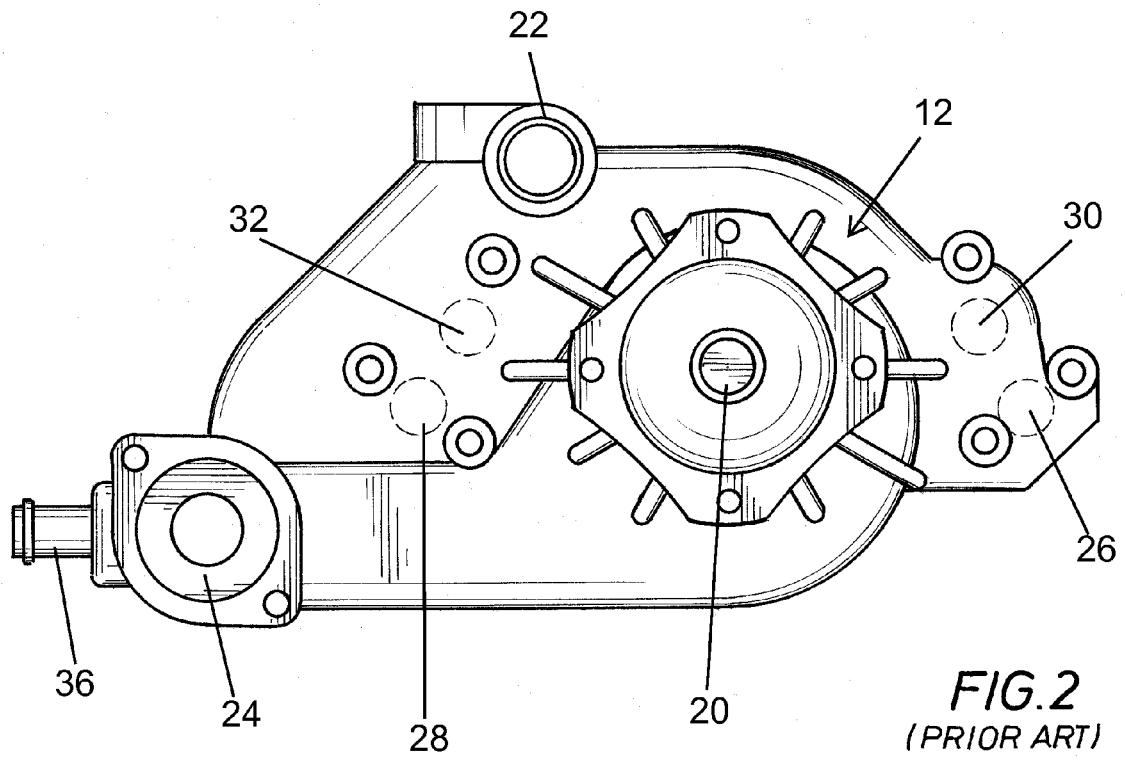
FIG.2 (PRIOR ART)
FIG. 2 is an elevational view of the water pump and water pump adapter shown in FIG. 1, used in the cooling system of a typical internal combustion engine.

Referring first to FIGS. 1 and 2, there is shown a prior art water pump and adapter/housing conventionally used in the cooling system of an internal combustion engine. It is to be understood that while the present invention will be described with particular reference to the use of the manifold or adapter of the present invention in conjunction with water-cooled internal combustion engines in vehicles, it is not so limited. It can be used with such engines having such water-cooled systems in any environment wherein space between the engine and the engine housing is at a premium and/or where it is desired to use a remotely positioned water pump.

Referring then to FIGS. 1 and 2, the water pump and housing/adapter, shown generally as 10, comprises a pump portion shown generally as 12 and a housing portion shown generally as 16. Pump portion 12 as is well known to those skilled in the art, is generally of a centrifugal pump design and has a series of vanes, i.e., an input impeller (not shown) rotatably mounted in a chamber housing 18 forming part of housing 16. The impeller is connected to a shaft 20 which is driven in a suitable fashion well-known to those skilled in the art whereby the impeller pumps water through the system including the engine, and a radiator. In this regard, there is an inlet 22 from the radiator, an outlet 24 to the radiator, inlets 26 and 28 from the pump assembly 10 into the block of the motor and outlets 30 and 32 from the cylinder heads. There is also a nipple 34 which leads to a heater and a return nipple 36 from the heater whereby hot water can be circulated through the heater for heating the interior of the vehicle as needed.

In operation, and when pump 12 is being driven, cooled water from the radiator is drawn into the pump assembly 10 via inlet 22, pumped through inlets 26 and 28 into the engine block, the water exiting from the head of the engine via outlets 30 and 32 and being returned to the radiator via outlet 24, the process being continuously repeated as long as the engine is running. It will be apparent from looking at FIGS. 1 and 2 that conventional water pumps are bulky and occupy a substantial amount of space in the engine compartment. Accordingly, this becomes a serious problem when there is a larger engine swapped for a smaller engine since the engine compartment space is now reduced, and accordingly the space in which the water pump/adapter can be positioned severely reduced. The present invention solves this problem.

Figures 3, 4, 5:
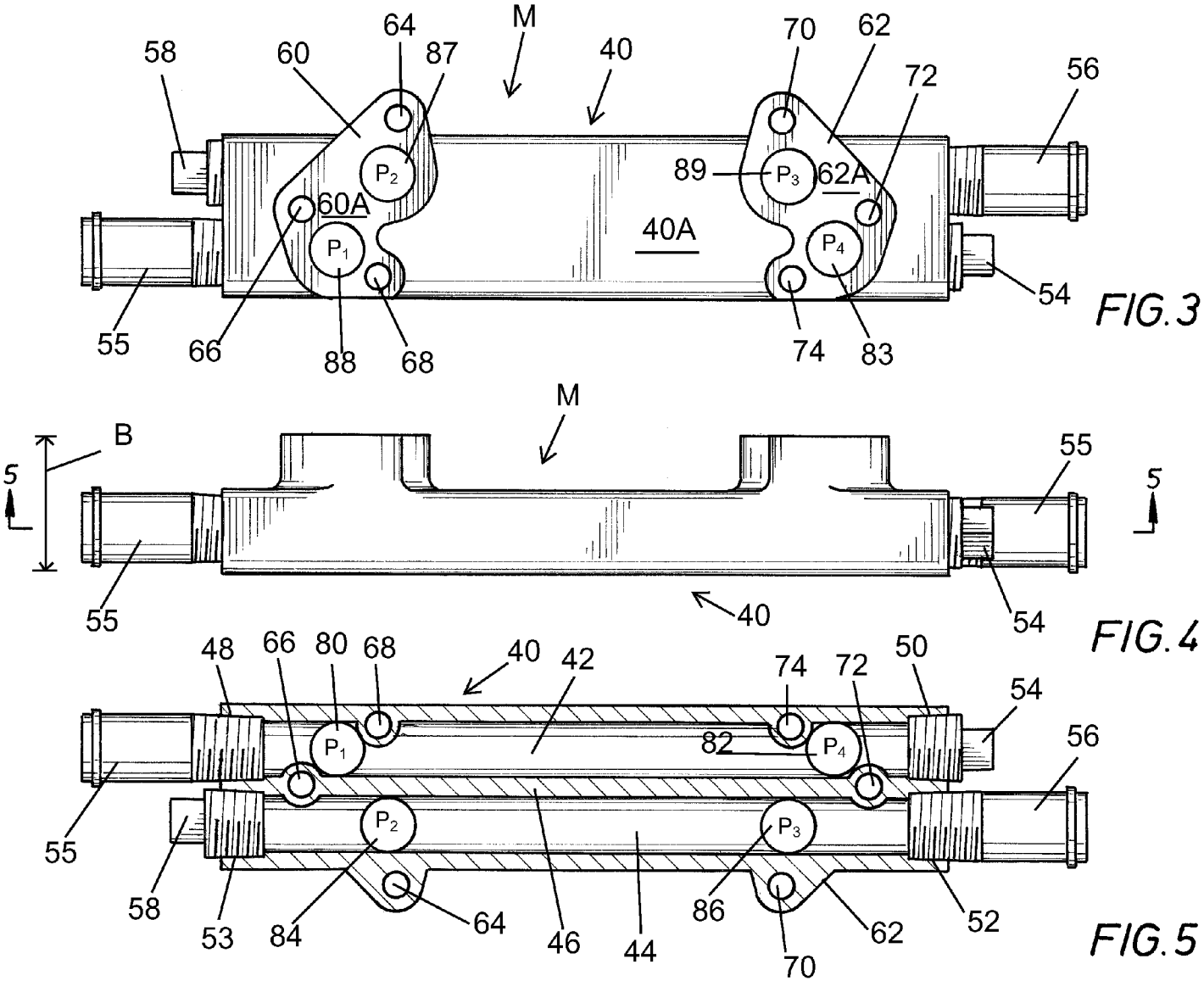
FIG. 3 is a rear, elevational view of the manifold or adapter according to one aspect of the present invention.
FIG. 4 is a plan view of the manifold shown in FIG. 3.
FIG. 5 is a cross-sectional view taken along the lines 5-5 of FIG. 4.

Reference is now made to FIGS. 3-5 for a description of one embodiment of the manifold or adapter of the present invention. The adapter or manifold of the present invention shown generally as M can include a body shown generally as 40 in which are formed a first chamber 42 and a second chamber 44, chambers 42 and 44 being separated by a partition 46 whereby the chambers 42 and 44 are isolated from one another. As can be seen, in the embodiment of FIGS. 3-5, body 40 is generally elongate in nature as are chambers 42 and 44. A first threaded port 48 opens into one end of chamber 42 while a second threaded port 50 opens into the opposite end of chamber 42. In like fashion, a first threaded port 52 opens into one end of chamber 44 while a second threaded port 53 opens into the opposite end of chamber 44. In the embodiment shown, a threaded nipple 55 is received in threaded port 48 while a threaded plug 54 is received in threaded port 50. Similarly, a threaded nipple 56 is received in threaded port 52 while a threaded plug 58 is received in threaded port 53. Formed through a wall 40A of body 40 into chamber 42 are first and second openings 80 and 82, openings 80 and 82 being generally disposed at opposite ends of chamber 42. In like fashion, and formed through wall 40A, but opening into chamber 44 are first and second openings 84 and 86.

Figure 8:
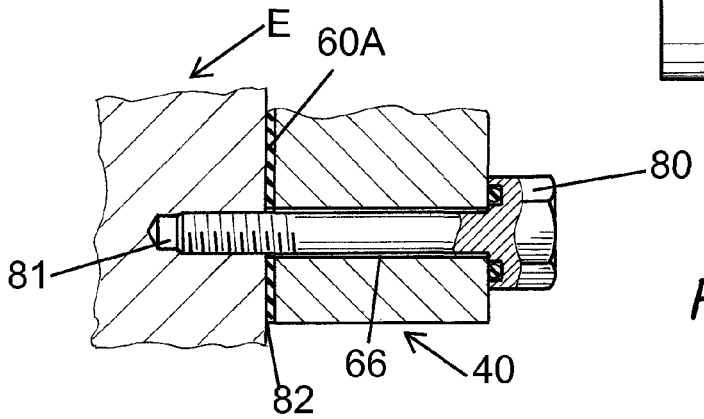
FIG. 8 is an enlarged view, partly in section showing a connection assembly for connecting the manifold to the engine.

As thus seen with reference to FIG. 3, formed integrally with body 40 is a first mount 60 and a second mount 62. Although in the embodiments shown, the mounts 60 and 62 are integrally or monolithically formed with body 40, it will be appreciated that they could be separate pieces and attached by bolts or some other fashion to body 40. Mount 60 has a series of bolt holes 64-68 formed therein, bolt holes 64-68 extending through body 40. In similar fashion, mount 62 has a series of bolt holes 70-74, holes 70-74 extending through mount 62 and body 40. Mount 60 has a gasket surface 60A while mount 62 has a gasket surface 62A. In this regard, and as best seen with reference to FIG. 8, to secure body 40 to the engine, a suitable bolt 80 would be received through one of the bolt holes, e.g., 66 and threadedly received in a threaded bore 81 of engine E, a gasket 82 being disposed between engine E and gasket surface 60A to form a water-tight seal between body 40 and engine E.

By comparing FIGS. 3 and 2, it can be seen that the bolt hole pattern of the bolt holes shown in the embodiment of FIG. 3 is the same as the pattern of the bolt holes shown in the water pump assembly 10 in FIG. 2. In this regard, the bolt hole patterns of the embodiment of the present invention shown in FIGS. 3-5 is designed to fit a GM LS Series engine. It will be understood that depending upon the particular engine, the bolt hole pattern in the manifold/mount would be adapted so as to fit the bolt hole pattern of the motor to which it is going to be attached.

Mount 60 has a first aperture 87 and a second aperture 88, aperture 87 being in register with opening 84, aperture 88 being in register with opening 80. Mount 62 is provided with an aperture 89 which is in register with opening 86 and a second aperture 83 in register with opening 82. Since in the embodiment shown the mounts 60 and 62 are integrally formed with body 40, opening 80 and aperture 88 cooperate to form a passageway P1 into chamber 42 while opening 84 and aperture 87 cooperate to form a passageway P2 into chamber 44. In like fashion, opening 86 and aperture 89 cooperate to form a passageway P3 into chamber 44 while opening 82 and aperture 83 form a passageway P4 into chamber 42. As noted above, if the mounts are separate from the body of the manifold, they would still have apertures and openings, respectively, which would be in register so as to form single openings or passageways into the respective chambers as described above. In this regard it would be appreciated that if the mounts were separate pieces from the body, suitable gaskets would be employed to ensure water tight sealing between the mounts and the body.

Another important advantage of the manifold of the present invention can be seen when comparing FIGS. 1 and 4 and particularly the distances indicated by the arrow A in FIG. 1 and B in FIG. 4. The distance A depicts the distance that the conventional water pump of FIG. 1 extends outwardly from the engine while distance B depicts the distance by which the manifold 40 extends outwardly from the engine. As can be seen, distance A is several orders of magnitude greater than distance B. Further, distance A does not include the distance that would be occupied by a drive pulley attached to the shaft 20 but not shown. Thus it can be seen that in a scenario where engine compartment space between the engine and the engine housing is at a premium, the manifold of the present invention is clearly superior.

While in the embodiments shown in FIGS. 3-5, the manifold is provided with plugs 54 and 58 to seal off two of the ports, such is not necessary. In other words, the manifold could be designed such that only one end of each of chambers 42 and 44 was open. For example, with respect to FIG. 5, there would be no bore 50 opening into chamber 42 and no bore 54 opening into chamber 44. However, the use of the configuration shown in FIGS. 3-5 where there are removable plugs 54 and 58 dramatically increases the versatility of the manifold 40 in that cooling flow through the engine can be easily reversed.

Figure 6:
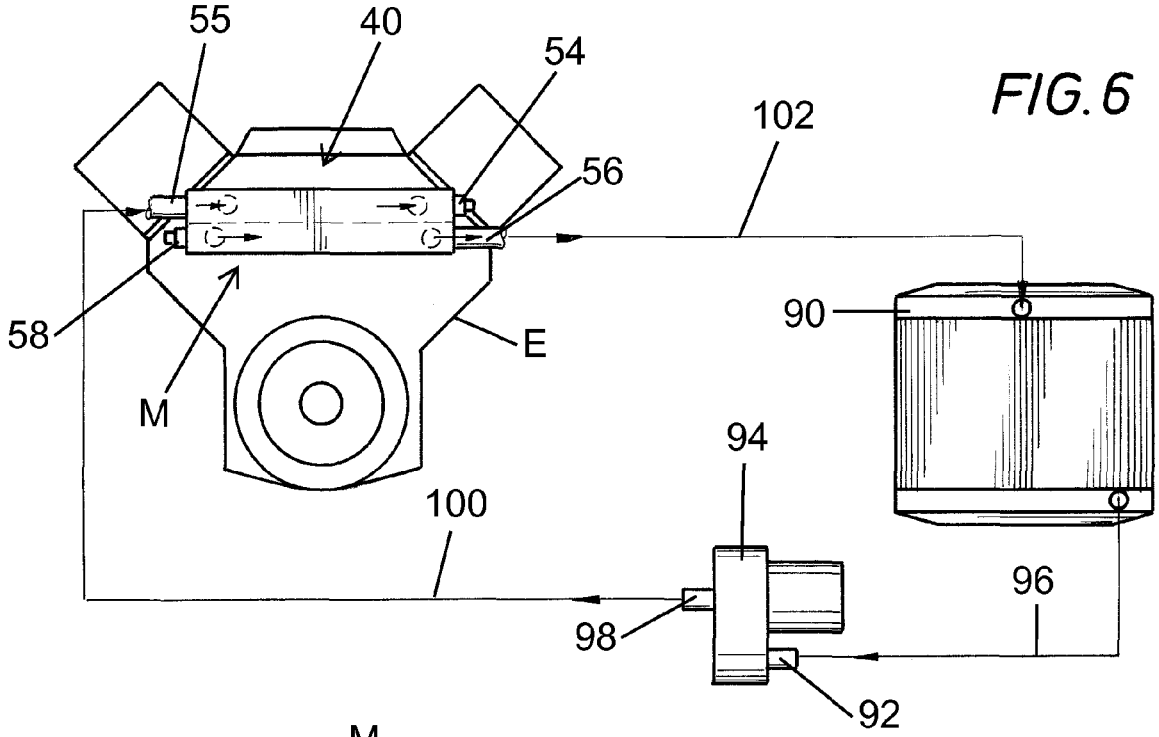
FIG. 6 is a schematic view of an engine and cooling system using the manifold of the present invention in a first engine cooling scheme.

Referring to FIG. 6, there is shown one embodiment of the present invention wherein the manifold 40 is connected to an engine E in a so-called reverse cooling mode, i.e., wherein cooled water from a radiator is first used to cool the engine head or heads (if it is a V-8 or V-6 engine) and then cool the block. Cooled water from a radiator 90 is drawn into the inlet 92 of a pump 94, inlet 92 being connected to radiator 90 by line, e.g., water hose tube or the like, 96. The water drawn into pump 94 is pumped out of outlet 98 into line (hose, tubing or the like) 100 where it is introduced into manifold M through nipple 55 into chamber 42 where it passes via passageways P1 and P4 into the head portion of engine E. The water passes through the head portion into the block of engine E and exits engine E through passageways P2 and P3 into chamber 44. It then passes out of chamber 44 through nipple 56 connected to a hose 102 and it is returned to radiator 90. Thus, as will be appreciated, in the embodiment shown in FIG. 6, the engine E is being reversed cooled in the sense that the cooling water is first introduced into the combustion heads and then the block before it is returned to the radiator.

Figure 7:
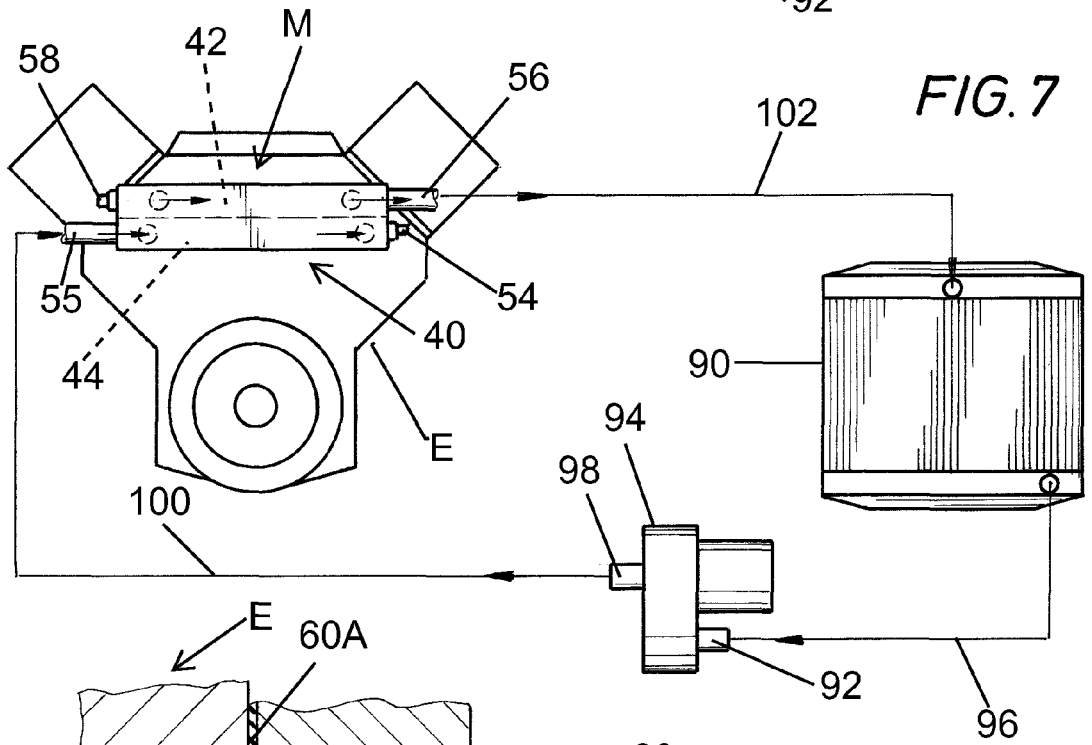
FIG. 7 is a view similar to FIG. 6 showing the manifold of the prevent invention used in a second engine cooling scheme.

Turning now to FIG. 7, it can be readily seen how, without removing the manifold M from the engine E, cooling can be conducted in the more conventional system wherein the block is cooled first followed by cooling of the combustion heads before the water is returned to the radiator. To do this conversion, it is only necessary that threaded plug 58 be removed from threaded bore 53 and replaced by threaded nipple 55, plug 58 being in turn received into threaded bore 48. A similar reversal occurs with respect to threaded nipple 56 and plug 54 all of which can be seen by comparing FIG. 6 with FIG. 7. As noted, a significant advantage of the manifold of the present invention is that to achieve this conversion of reverse cooling to conventional cooling of engine E or vice versa, it is unnecessary to remove the manifold end from the engine. Rather, it is simply a question of exchanging the positions of the nipples and plugs. As thus connected in FIG. 7, the cooling water first cools the block of engine E and then the combustion heads of engine E.

It will be appreciated that if the ability to easily and quickly effect reverse cooling is not desired, plugs 54 and 58 could be dispensed with. In other words, the body 40 would not have threaded bores 50 and 53. Stated differently, there would only be one nipple 55 which opened into chamber 42 and one nipple 56 which opened into chamber 44. Thus, for example, in the embodiment shown in FIG. 7, the cooling water would enter manifold M through nipple 55 into chamber 44, pass through the block of engine E, through the combustion head of engine E, back into chamber 42 and exit manifold M via nipple 56 to be returned to radiator 90.

The terms "water hose," "hose," or "tubing" are intended to include any suitable conduit through which water or similar liquid can be passed from one location or piece of equipment to another location or piece of equipment. Thus, and by way of example only, the word "hose" is interchangeable with the word "tubing" and vice versa, the same being true for "water hose."

Although specific embodiments of the invention have been described herein in some detail, this has been done solely for the purposes of explaining the various aspects of the invention, and is not intended to limit the scope of the invention as defined in the claims which follow. Those skilled in the art will understand that the embodiment shown and described is exemplary, and various other substitutions, alterations and modifications, including but not limited to those design alternatives specifically discussed herein, may be made in the practice of the invention without departing from its scope.

What is claimed is:

1. A manifold assembly for use in a cooling system of a water cooled internal combustion engine having a water pump, comprising:

a monolithic body;

a first chamber within said monolithic body and a second chamber within said monolithic body, said first and second chamber isolated from one another by a partition, said first chamber having a first port, a first opening and a second opening, said second chamber having a first port, a first opening and a second opening; and first and second mounts connected to said body and adapted to mount said body on an engine, said first mount having a first aperture in open communication with said first opening in said first chamber and a second aperture in open communication with said first opening in said second chamber, said second mount having a first aperture in open communication with said second opening in said first chamber and a second aperture in open communication with said second opening in said second chamber, said first aperture in said first mount and said first opening in said first chamber comprising a first passageway, said first aperture in said second mount and said second opening in said first chamber comprising a second passageway, said second aperture in said first mount and said first opening in said second chamber comprising a third passageway and said second aperture in said second mount and said second opening in said second chamber comprising a fourth passageway.

2. The manifold assembly of claim 1, wherein said first and second mounts are integrally formed with said body.

3. The manifold assembly of claim 1, wherein said first port in said first chamber is adapted to be connected to a hose, said first port in said second chamber is adapted to be connected to a hose.

4. The manifold assembly of claim 1, wherein said first chamber has a second port and said second chamber has a second port.

5. The manifold assembly of claim 4, wherein one of said first and second ports in said first chamber is adapted to be connected to a hose and said other of said first and second ports in said first chamber is adapted to receive a plug and one of said first or second ports in said second chamber is adapted to be connected to a hose and the other of said first and second ports in said second chamber is adapted to receive a plug.

6. The manifold assembly of claim 5, wherein said first and second ports in said first chamber and said first and second ports of said second chamber comprise threaded bores.

7. The manifold assembly of claim 6, wherein one of said first and second threaded bores in said first chamber is adapted to receive a threaded nipple and the other of said first and second threaded bores in said first chamber is adapted to receive a threaded plug and one of said first and second threaded bores in said second chamber is adapted to receive a threaded nipple and the other of said first and second threaded bores in said second chamber is adapted to receive a threaded plug.

8. A cooling system for an internal combustion engine, comprising:

a cooling radiator having an inlet and an outlet;

a pump having an intake and an output, said intake of said pump being connected to said outlet of said radiator;

a manifold adapted to be mounted on said engine and having an inlet connected to said pump output for directing cooled water into said engine and receiving heated water from said engine, said manifold having an outlet connected to said cooling radiator inlet whereby heated water from said engine is returned to said radiator, said pump being remotely disposed from said manifold wherein said manifold comprises the manifold assembly of claim 1.

9. The cooling system of claim 8, wherein said manifold comprises the manifold assembly of claim 5.

* * * * *